United States Patent [19]

Shimizu

[11] Patent Number: 5,005,607

[45] Date of Patent: Apr. 9, 1991

[54] HEALD FRAME FOR LOOMS

[75] Inventor: Yoichi Shimizu, Osaka, Japan

[73] Assignee: Nankai Kogyo Kabushiki Kaisha, Osaka, Japan

[21] Appl. No.: 483,526

[22] Filed: Feb. 21, 1990

[30] Foreign Application Priority Data

May 22, 1989 [JP] Japan ..... 1-59412[U]

[51] Int. Cl.[5] ..... D03C 9/06

[52] U.S. Cl. ..... 139/91; 403/53

[58] Field of Search ..... 139/91, 92; 403/53, 403/59, 80

[56] References Cited

U.S. PATENT DOCUMENTS

| | | | |
|---|---|---|---|
| 4,015,638 | 4/1977 | Graf | 139/91 |
| 4,307,757 | 12/1981 | Shimizu | 139/91 |
| 4,355,667 | 10/1982 | Shimizu | 139/91 |
| 4,883,095 | 11/1989 | Maruyama et al. | 139/91 |

FOREIGN PATENT DOCUMENTS 111741 4/1989 Japan .

*Primary Examiner*—Andrew M. Falik

*Attorney, Agent, or Firm*—Browdy and Neimark

[57] ABSTRACT

A heald frame, constructed to have upper and lower framestaves and left and right side stays coupled to one another, the coupling between the framestaves and the side stays adjustable to increase or decrease the distance between the upper framestave and the lower framestave. The heald frame is also able to change the distance between upper and lower carrier rods, which are fixed to the upper and lower framestaves respectively, thereby permitting the adjustment of the distance between the ends of a multiplicity of healds which span a distance between the upper and lower carrier rods. The coupling is made from a side stay with a jointing convex part capable of being adjustably coupled to a holder. The adjustable jointing convex part and the holder, which are mounted together in the framestaves, are adapted to be fixed in a selected position. This results in the ability to vertically adjust the framestave in relation to the side stay and in course, the distance between cooperating carrier rods and the ends of healds carried thereon.

7 Claims, 3 Drawing Sheets

HEALD FRAME FOR LOOMS

FIELD OF THE INVENTION

The present invention relates to improvements in a heald frame for a loom, and more specifically to a heald frame, constructed to have framestaves and side stays coupled to one another, in a manner which permits vertical movement of the framestave in relation to the side stay.

BACKGROUND OF THE INVENTION

A heald frame comprises a square framework constructed to have framestaves acting as upper and lower frames coupled to side stays acting as left and right frames. The heald frame is equipped to support the warp ends of a multiplicity of healds. Carrier rods are fixed to the upper and lower framestaves respectively, and the healds, span the space between the upper and lower carrier rods. Thus, the heald frame, equipped with a multiplicity of healds, is incorporated into a loom and, then is vertically moved in a reciprocal manner. The conventional loom is operated at a very high speed which moves the heald frame up and down at an equivalent high speed. As a result, severe inertial forces act upon the heald frame, causing deformation and vibration in the frame.

In order to cope with the deformation and vibration in the frame, conventional frames are provided with appropriate clearances between coupling ends of the heald frame and its carrier rods. If these clearances are made either too large or too small the loom will not function properly. If the clearance is large, a severe swinging of the healds from the high speed movement of the heald frame may cause the warp ends to be cut or give rise to fuzzing of the woven cloth. If the clearance is too small, deformation of the frame may result in broken healds.

The conventional heald frame which employs a fixed coupling system makes it difficult to maintain appropriate clearances. Experience indicates that even if appropriate clearances are provided at the design stage, errors in assembling the heald frame lead to inadequate clearances. Further, long-term usage of such frames may cause the coupled ends of the frames to become so worn that clearance amount is enlarged to a point that the frame does not function properly. Furthermore, appropriate clearances are subject to the conditions under which the weaving process is undertaken. Thus, the appropriate clearance also depends upon the thickness of the yarn or operation speed of the loom. For this reason, no matter how the clearance amount is set at the design stage of making the heald frame, the frame's usage may sometimes result in the need for different clearances.

Thus, although it is important that an appropriate clearance between the coupling ends of the heald frame and the carrier rod be maintained, the conventional heald frame does not possess any means of correcting the clearance amount because the upper and lower framestaves are fixed so as to maintain a chosen distance between the upper and lower carrier rods.

SUMMARY OF THE INVENTION

The primary object of the present invention is to provide a heald frame where moving the positions of coupling the framestaves and the side stays to one another enables the distance between the upper and lower carrier rods, which are mounted to the upper and lower frame staves respectively, to be increased or decreased. Thus, the clearances where the healds are mounted to the carrier rods are always appropriate, depending upon the conditions under which the weaving process is undertaken.

Another object of the present invention is to provide a heald frame wherein, swinging of the healds can be restrained when operating at high speed, thereby preventing a cutting of the warp ends and a fuzzing on the woven cloth and damage to the healds.

A further object of the present invention is to provide a heald frame wherein a positional adjustment of the parts coupling the framestaves and the side stays can be easily executed since construction of the heald frame provides for adjustable couplings between the framestaves and the side stays which also provide for easy assembly and disassembly of the frame.

Other features and advantages of the present invention will be apparent from the following description made in conjunction with the accompanying drawing.

DETAILED DESCRIPTION OF THE PREFERRED EMBODIMENTS

Figure 1:
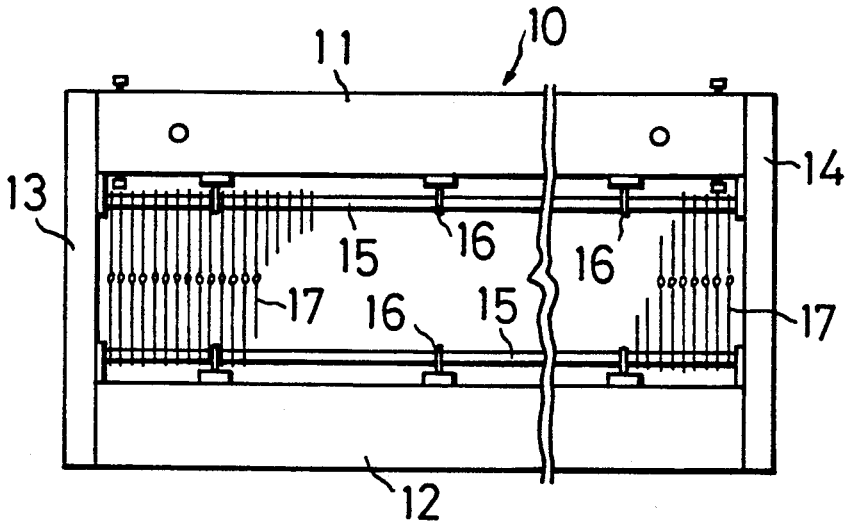
FIG. 1 is a front view of one embodiment of the heald frame of the present invention to which the healds are mounted.

One Embodiment of the heald frame according to the present invention is illustrated in FIG. 1. The heald frame 10 comprises the upper and lower framestaves 11 and 12 acting as the upper and lower frames respectively and side stays 13 and 14 acting as the left and right frames respectively. A coupling of the ends of the framestaves 11 and 12 and the ends of side stays to one another results in a square framework. The upper and lower carrier rods 15 are mounted both to healds 17 and through hangers 16 to the framestaves 11 and 12. A multiplicity of healds 17, are mounted to span the distance between the carrier rods 15.

Figure 2:
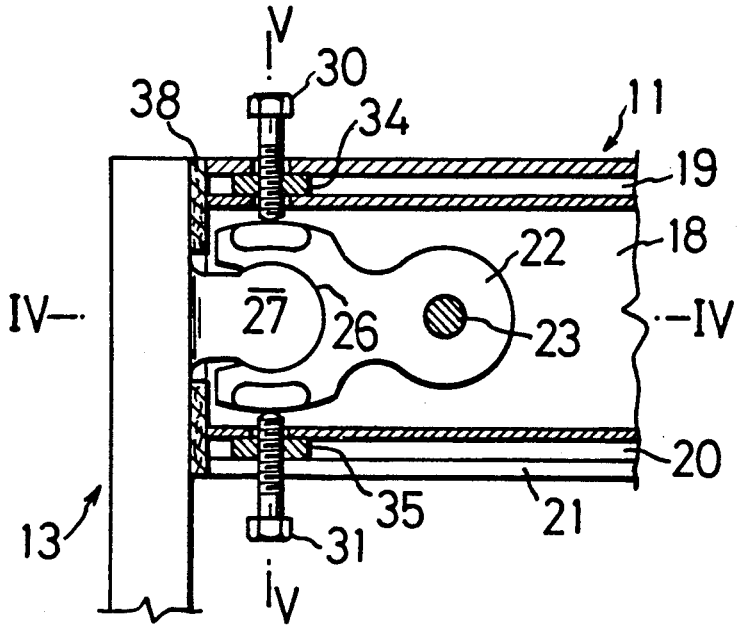
FIG. 2 is an enlarged sectional view of one of the parts coupling the framestaves and the side stays to one another, which constitute the heald frame of FIG. 1.

FIG. 2 illustrates a structure of the coupling between the upper framestaves 11 and the left side stay 13. The coupling is identical to the coupling between the upper framestaves and the right side stay 14. It is not, however, always necessary that the coupling between the lower framestave 12 and the left and right side stays 13 and 14 be the same as the aforementioned structure. A structure similar to that of the couplings in conventional heald frames, for example, may be acceptable. The inside of the framestaves 11 is hollow, the space being divided into three portions. A central space 18 is relatively larger than the spaces 19 and 20 along both the sides, which are relatively smaller. The space 20 has a slit 21 running along the full length of its inner wall face. The slit 21 is able to support the hangers 16 such that their positions are movable.

Figure 6:
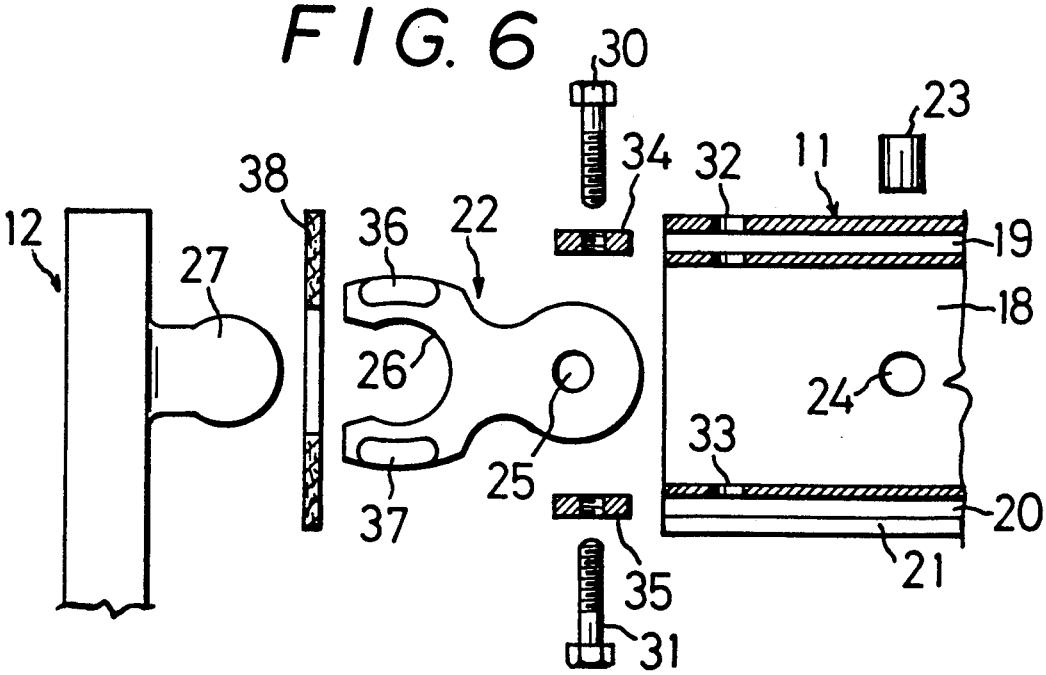
FIG. 6 is an exploded view of the state illustrated in FIG. 2.

The central space 18 contains a holder 22. The holder 22 is supported to the wall face of the framestave 11 by means of a pin shaft 23. The holder 22 can be rotated silently to and fro in the space 18 with the pin shaft 23 as a fulcrum. The pin shaft 23, one unit of short round rod as shown in FIG. 6, runs through a pin hole 24 of the framestave 11 and the pin hole 25 of the holder 22 and is fixed to the pin hole 24 by caulking. From the perspective of facilitating disassembly of the pin shaft 23, it is possible to make pin shaft 23 in two portions which are threaded together.

In the embodiment of FIG. 2, the holder 22 is made of metallic material. It may also be acceptable to use slightly flexible plastic. The holder 22 has a jointing concave part 26. An inner peripheral edge of the jointing concave part 26 is of a circular shape. On the other hand, the upper end part of side stay 13 has a jointing convex part 27 whose outer peripheral edge is of a circular shape. The jointing concave part 26 and the jointing convex part 27 are fitted into each other. The circular shape of both the peripheral edges of these parts 26 and 27 enables the parts to be slidably connected to each other.

The holder 22 is held from both sides by two units of bolts 30 and 31. The bolts 30 and 31 are extended through the holes 32 and 33 made in the framestave 11 and the slit 21 into the inside of the space 18. Bolts 30 and 31 are threaded to nuts 34 and 35 which are inserted into the spaces 19 and 20 respectively. The square outer shape of the nuts 34 and 35 prevent their turning in the spaces 19 and 20. Nuts 34 and 35 are fitted into the spaces 19 and 20, in close contact so that rotation of nuts 34 and 35 therein is not possible. In order to prevent wear on the holder 22 by the ends of the bolts 30 and 31, wear resistant patches 36 and 37 are provided. Packings 38 are interposed between the framestave 11 and the side stay 13.

The coupling of FIG. 2 may be disassembled or assembled in the following ways. One way is taking out the pin shaft 23, plus the holder 22 from the space 28 of the framestaves 11 with the holder 22 being still coupled to the jointing convex part 27 of the side stay 13. An alternative way, when holder 22 is made of soft material, is forceably pulling side stay 13 away from the jointing convex part 26 while the holder 22 is still mounted to the inside of the space 18.

Figure 3:
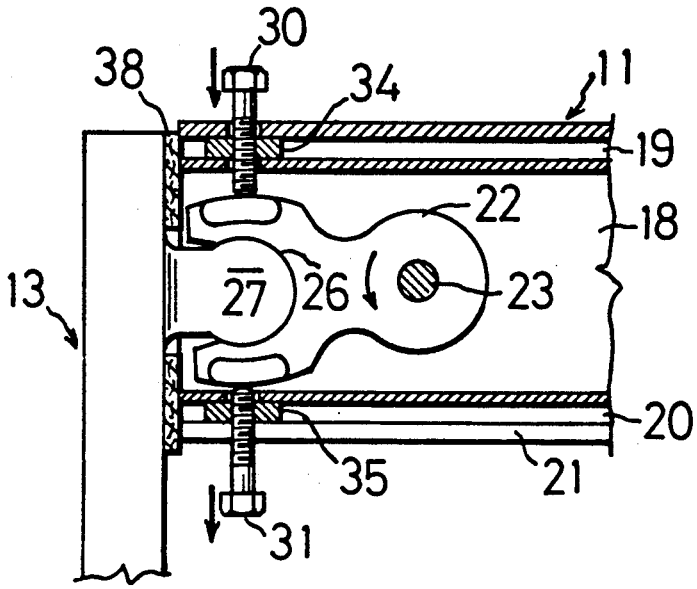
FIG. 3 is a sectional view of the state wherein the jointing position is moved from the one illustrated by FIG. 2.
Figure 5:
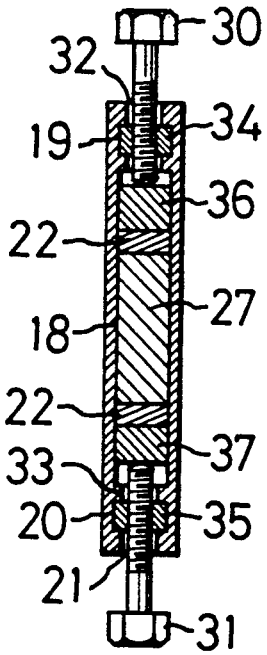
FIG. 5 is an enlarged sectional view taken on line V—V of FIG. 2.
Figure 4:
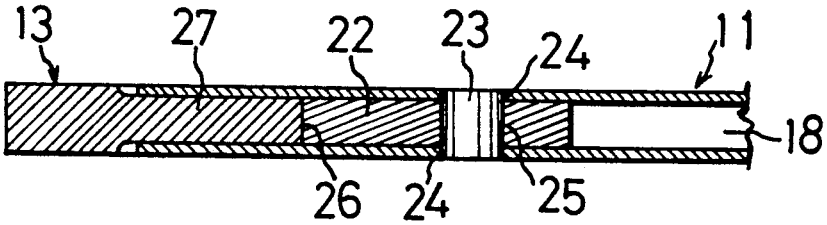
FIG. 4 is an enlarged sectional view taken on line IV—IV of FIG. 2.

The following process is undertaken to change the relative position between the framestave 11 and the side stay 13 when coupled to each other. When holder 22 is fixed by the bolts 30 and 31, its position can be changed by altering the threaded positions of bolts 30 and 3!. This is possible since the bolts 30 and 31 are threaded to the nuts 34 and 35 respectively and the nuts 34 and 35 are fixed in the spaces 19 and 20. Thus, a turn of the bolts 30 and 34 lets them retreat or advance in relation to holder 22. For example, FIG. 3 shows bolt 31 being threaded away from holder 22 while bolt 30 is threaded toward holder 22. This results in holder 22 rotating slightly counterclockwise with the pin shaft as a fulcrum. As a result, the position of the jointing concave part 26 is moved downward. The coupling of jointing convex part 27 to jointing concave part 26 permits the relative position between the framestave 11 and the side stay 13 to be changed. Thus, if the side stay 13 is assumed as a reference, the resulting state may be that the framestave 11 is moved relatively upward. In such a motion, a slight sliding takes place between the jointing concave part 26 and the jointing convex part 27. Since the parts are cooperating male and female elements the motion is substantially frictionless.

The above description demonstrates how the operation of bolts 30 and 31 vertically moves the position of the frame 11 with respect to the side stay 13. The coupling of the right side stay 14 and the framestave 11 has the same structure as above, thereby permitting the same vertical movement described above. Thus, moving the position of the framestave 11 at its left and right sides allows the interval between the upper and lower carrier rods 15 to be adjusted, thereby making it possible to adjust for appropriate clearances in supporting ends of the healds 17. Normally, a vertical adjustment of framestave 11 in relation to side stay 13 is about +2 to +3 mm, and less than +5 mm at most.

Figure 7:
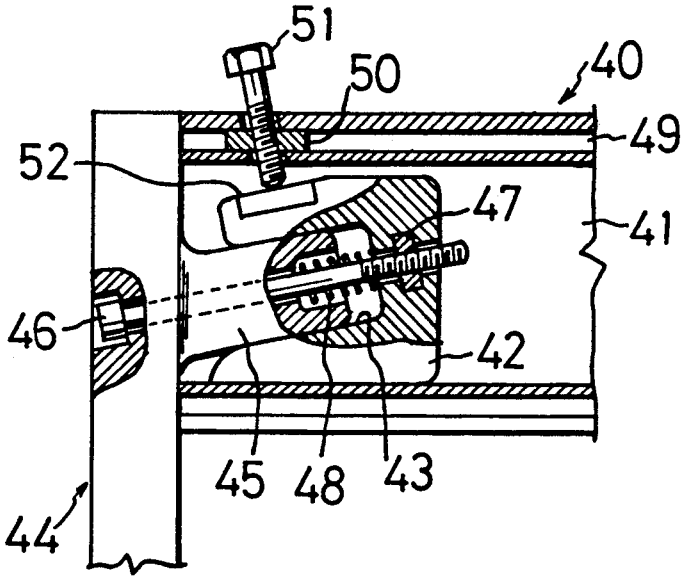
FIG. 7 is a sectional view of one of the jointing parts according to another embodiment.

FIG. 7 illustrates another embodiment of a different structure of the part coupling the framestave and the side stay to each other. The holder 42 is slidably fitted into the space 41 in the framestave 40. The holder 42 has a jointing concave part 43. The upper and lower edges of jointing concave part 43 as shown in FIG. 7 are upwardly inclined away from side stay 44 and are parallel to each other. The side stay 44 has a jointing convex part 45 whose shape corresponds to that of jointing concave part 43. The jointing concave part 43 and the jointing convex part 45 are slidably fitted into each other. A bolt 46 penetrates along a line ranging from the outer side of the side stay 44 to the center of the jointing convex part 45 and further penetrates the holder 42. A nut 47, fixed into the holder 42, is threaded to the bolt 46. When bolt 46 is turned it slides the jointing concave part 43 with respect to the jointing convex part 45. A spring 48 interposed between the jointing concave part 43 and the jointing convex part 45 assists in maintaining parts 43 and 45 in adjusted position. A bolt 51, penetrating inclinatorily the wall face of the frame stave 40, is threaded to the nut 50 which fits into the space 49 of the framestave 40. The top end of nut 51 is in contact with an inclined wall 52 of the holder 42. Fastening bolt 51 against holder 42 fixes holder 22 within space 41.

In this embodiment, a rotation of bolt 46 together with the loosening of bolt 51 will result in increasing or decreasing the amount of penetration of jointing convex part 45 into jointing concave part 43. Subsequent fastening of the bolt 51 will permit the holder 42 to be fixed. The above description demonstrates how the movement of part 45 in relation to part 43 vertically moves the position of framestave 40 with respect to side stay 44. The coupling according to this embodiment, can be assembled or disassembled by loosening the bolt 51, and then drawing holder 42 and jointing convex part 45 from the space 41 together.

Figure 8:
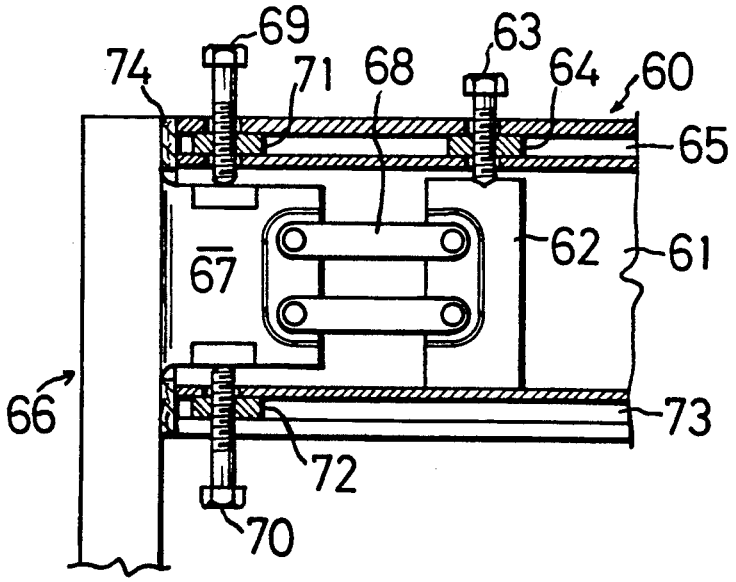
FIG. 8 is a sectional view of one of the jointing parts according to a further embodiment.

FIG. 8 illustrates another embodiment of coupling the framestave and the side stay. The holder 62 is fitted into space 61 of framestave 60. The holder 62 is held fixed in a predetermined position by means of the bolts 65 penetrating the wall of framestave 60. Bolt 63 is threaded to nut 64 which fitted into the space 65. The jointing convex part 67 which is integrated with the side stay 66 is fitted into the space 61 of the framestave 60. The jointing convex part 67 and the holder 62 are shown pivotally connected to each other by parallel links 68. The jointing convex part 67 has both its sides interposed between bolts 69 and 70 which penetrate the upper and lower walls of the framestave 60 so that the jointing convex part 67 can be fixed in place. The nuts 71 and 72 into which the bolts 69 and 70 are threaded are fitted into the spaces 65 and 73 respectively. Since the upper and lower sides of the jointing convex part 67 are interposed between the top ends of the bolts 69 and 70 respectively, a rotational operation of the bolts 69 and 70 will cause the position of the jointing convex part 67 to be vertically moved, thereby making it possible to adjust the position of framestave 60 and the side stay 66 to each other. The coupling can be disassembled by loosening all of the bolts 63, 69, and 70 and removing them from the space 61. The amount of changing of an interval between the jointing convex part 67 and the holder 62, when making an adjustment of the coupling position, is so small that it is absorbed by packings 74.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

What is claimed is:

1. A heald frame for a loom comprising:

a hollow framestave having upper and lower walls;

a holder supported in the hollow of said framestave;

a side stay having a jointing convex part thereon;

said jointing convex part extending into the hollow of said framestave;

means for adjustably engaging said jointing convex part to said holder in different positions;

means for adjusting and fixing said jointing convex part to said holder in a selected position;

whereby said hollow framestave can be vertically adjusted in relation to said side stay.

2. A heald frame, as defined in claim 1, wherein;

said means for adjustably engaging said jointing convex part to said holder in different positions comprises;

a circular concave part on said holder;

a circular convex part being circular and substantially corresponding in diameter to said circular concave part on said holder;

said circular concave part rotatably engaged to said circular convex part;

and said holder pivotally mounted in a space in said framestave by a shaft pin.

3. A heald frame, as defined in claim 2 wherein;

said means for adjusting and fixing said jointing convex part to said holder in a selected position comprises;

a plurality of bolts threaded through said upper and lower walls of said framestave;

said holder being interposed between the ends of said bolts;

whereby, said holder can be adjusted and fixed in a selected position by turning said bolts.

4. A heald frame, as defined in claim 1, wherein said means for adjustably engaging said jointing convex part to said holder in different positions comprises;

said holder with a concave part upwardly inclined in a direction away from said side stay;

an inclined convex part substantially corresponding in shape to said inclined concave part on said holder;

wherein said inclined concave part is slidably engaged to said convex part.

5. A heald frame, as defined in claim 4 wherein;

said means for adjusting and fixing said jointing convex part to said holder in a selected position comprises;

spring means interposed in a cavity between said inclined concave part and said inclined convex part;

a first threaded bolt; a shank of said bolt passing through said side stay and said inclined convex part; said first bolt threaded to said holder for adjustably drawing said holder toward said side stay; and a second threaded bolt threaded through said framestave adapted to engage and fix said holder in a selected position attained by said first bolt drawing said holder toward said side stay.

6. A heald frame, as defined in claim 1 wherein;

said means for adjustably engaging said jointing convex part to said holder in different position comprises;

a plurality of parallel links;

a first end of said links pivotally connected to said jointing convex part;

a second end of said links pivotally connected to said holder; and said holder fixed in a space in said framestave by a first bolt threaded through said framestave.

7. A heald frame, as defined in claim 6 wherein;

said means for adjusting and fixing said jointing convex part to said holder in a selected position comprises;

second and third bolts, respectively threaded through the upper and lower walls of said framestave;

said jointing convex part interposed between the ends of said second and third bolts;

whereby said jointing convex part can be adjusted and fixed in a selected position by turning said second and third bolts.

* * * * *